US005782176A

United States Patent [19]

Bevan

[11] Patent Number: 5,782,176

[45] Date of Patent: Jul. 21, 1998

[54] MATERIAL PRESS HAVING PIVOTALLY CONNECTED CRUSHING LID AND A REDUCIBLE HEIGHT FOR TRANSIT

[75] Inventor: James A. Bevan, Ottumwa, Iowa

[73] Assignee: Al-jon, Inc., Ottumwa, Iowa

[21] Appl. No.: 687,118

[22] Filed: Jul. 23, 1996

[51] Int. Cl.[6] ..... B30B 9/32

[52] U.S. Cl. ..... 100/100; 100/269.19; 100/901

[58] Field of Search ..... 100/100, 269.19, 100/901

[56] References Cited

U.S. PATENT DOCUMENTS

| | | | |
|---|---|---|---|
| 3,266,413 | 8/1966 | Sharp et al. . | |
| 3,404,622 | 10/1968 | Flanagan . | |
| 3,517,608 | 6/1970 | Tezuka | 100/901 |
| 3,564,994 | 2/1971 | Mosley . | |
| 3,757,680 | 9/1973 | Williams | 100/901 |
| 5,655,443 | 8/1997 | Hall | 100/901 |

FOREIGN PATENT DOCUMENTS

| | | | |
|---|---|---|---|
| 2029299 | 3/1980 | United Kingdom | 100/100 |

*Primary Examiner*—Stephen F. Gerrity

*Attorney, Agent, or Firm*—McAndrews, Held & Malloy, Ltd.

[57] ABSTRACT

A material press includes a base portion defining a generally horizontal bed upon which a vehicle (or other material) to be crushed may be placed. Material placed on the bed is crushed by a lid portion which is slidably movable relative to the base along a pair of vertical guide mechanisms by a pair of hydraulic cylinders. Each vertical guide mechanism includes two guide posts. Guide sleeves which slide along the posts are pivotally connected to the four corners of the lid by pivot linkages. The casings of the hydraulic cylinders are movable between a raised position for performing crushing operations and a lowered position to reduce the overall height of the crusher during transportation between job sites. A locking mechanism is provided for quickly locking and unlocking the cylinder casings in their raised position. The base of the material press may be form of a semi-trailer to permit the press to readily be moved between job sites.

20 Claims, 11 Drawing Sheets

MATERIAL PRESS HAVING PIVOTALLY CONNECTED CRUSHING LID AND A REDUCIBLE HEIGHT FOR TRANSIT

FIELD OF THE INVENTION

The present invention relates to a material press or crusher, and more particularly, to a press having a base upon which a vehicle (or other material) to be crushed may be placed and a lid portion which is movable relative to the base for crushing the material placed on the base.

BACKGROUND OF THE INVENTION

A well-known design for a material press, referred to as a lid-type crusher, includes a stationary base upon which the vehicle to be crushed is placed and a lid which is moved, relative to the base, by a pair of hydraulic cylinders for crushing the vehicle which is placed on the base. Typically, these presses are in the form of a semi-trailer so that they can be moved between job sites; however, stationary presses are also used in some instances. A disadvantage of most portable lid-type crushers is that these devices perform the crushing action during the hydraulic cylinders retraction stroke, as opposed to their extension stroke. This is a disadvantage because hydraulic cylinders are more efficient during their extension stroke than their retraction stroke. The primary reason known car crushers operate in this mode is to ensure that the hydraulic cylinders and other vertically extending portions of the crusher do not extend above the maximum height limits imposed on vehicles traveling on public roadways.

In recognition of this problem, U.S. Pat. No. 3,404,622 ("the '622 patent"), which issued on Oct. 8, 1968 to Robert L. Flannagan, discloses a portable lid-type crusher in which the hydraulic casings of the hydraulic cylinders can be lowered to reduce the overall height of the crusher during transportation. At the job site, fasteners are used to lock the cylinder casings in a raised position to permit the crushing operation to be performed during the more efficient extension stroke of the hydraulic cylinders. The mobile crusher disclosed in the '622 patent relies on mechanical fasteners to lock the cylinder casings in their raised position. These mechanical fasteners must be manually installed and removed, as a result, set up and take down of the cylinders is time consuming and cumbersome.

SUMMARY OF THE INVENTION

An object of the present invention is to provide a lid-type material press in which the crushing force is evenly distributed across the crusher lid.

Yet another object of the present invention is to provide a material press which performs the crushing operation during the extension stroke of the hydraulic cylinders.

A further object of the present invention is to provide a material press into which material to be crushed may be readily loaded.

Another objective of the present invention is to provide a mobile material press or crusher whose overall height may be appreciably reduced for and during transit of the mobile material press from one location to another.

Still another object of the present invention is to provide a mobile material press having a reduced set up time in comparison to known mobile material presses.

Another object of the present invention is to provide a mobile material press which is easy to operate and maneuver.

The above and other objects and advantages are achieved by a material press comprising a generally horizontal, elongated bed having a first and second guide mechanism extending vertically from opposite ends of the bed. A lid is slidably connected to the guide mechanisms for vertically movement relative to the bed between an upper position at which the lid is vertically displaced from the bed and a lower position at which the lid is juxtaposed next to the bed. A pair of hydraulic cylinders are mounted on the press for moving the lid between its upper and lower positions.

Each of the cylinders has an outer casing and a cylinder rod extending from the casing lower end and being movable between an extended position and a retracted position in response to hydraulic fluid supplied to the cylinder casing from an external source. According to one aspect of the present invention, the cylinder casings are slidable with respect to the guide mechanisms between a lowered position at which the casing lower end is proximal to the bed and a raised position at which the casing lower end is vertically displaced from the bed by a distance which exceeds the stroke length of the cylinder rod. A locking mechanism is provided for controllably locking the casing at its raised position.

The cylinder casings may be moved to their lowered position to reduce the overall height of the mobile press during movement between locations by disengaging the locking mechanism and retracting the cylinder rods. The casings may be raised to their upper position by moving the cylinder rods to their extended positions at which time the locking mechanism is activated to lock the casings in its raised position after which the lid may be raised by retracting the cylinder rods and lowered by extending the cylinder rods.

According to another aspect of the present invention, each of the guide mechanisms comprises a pair of laterally spaced guide posts which extend vertically a respective end of the bed. First and second guide sleeves are slidably mounted on the first and second pairs of guide posts, respectively. The lid in turn has its corners pivotally connected to the guide sleeves by pivot linkages which permit the lid to pivot relative to the guide sleeves about two axes, each axis being generally parallel to the bed and generally perpendicular to the vertical axis of the guide posts.

BRIEF DESCRIPTION OF THE DRAWINGS

For a more complete understanding of this invention reference should now be had to the embodiment illustrated in greater detail in the accompanying drawings and described below by way of example of the invention.

In the drawings.

DETAILED DESCRIPTION OF THE PREFERRED EMBODIMENTS

Figure 1:
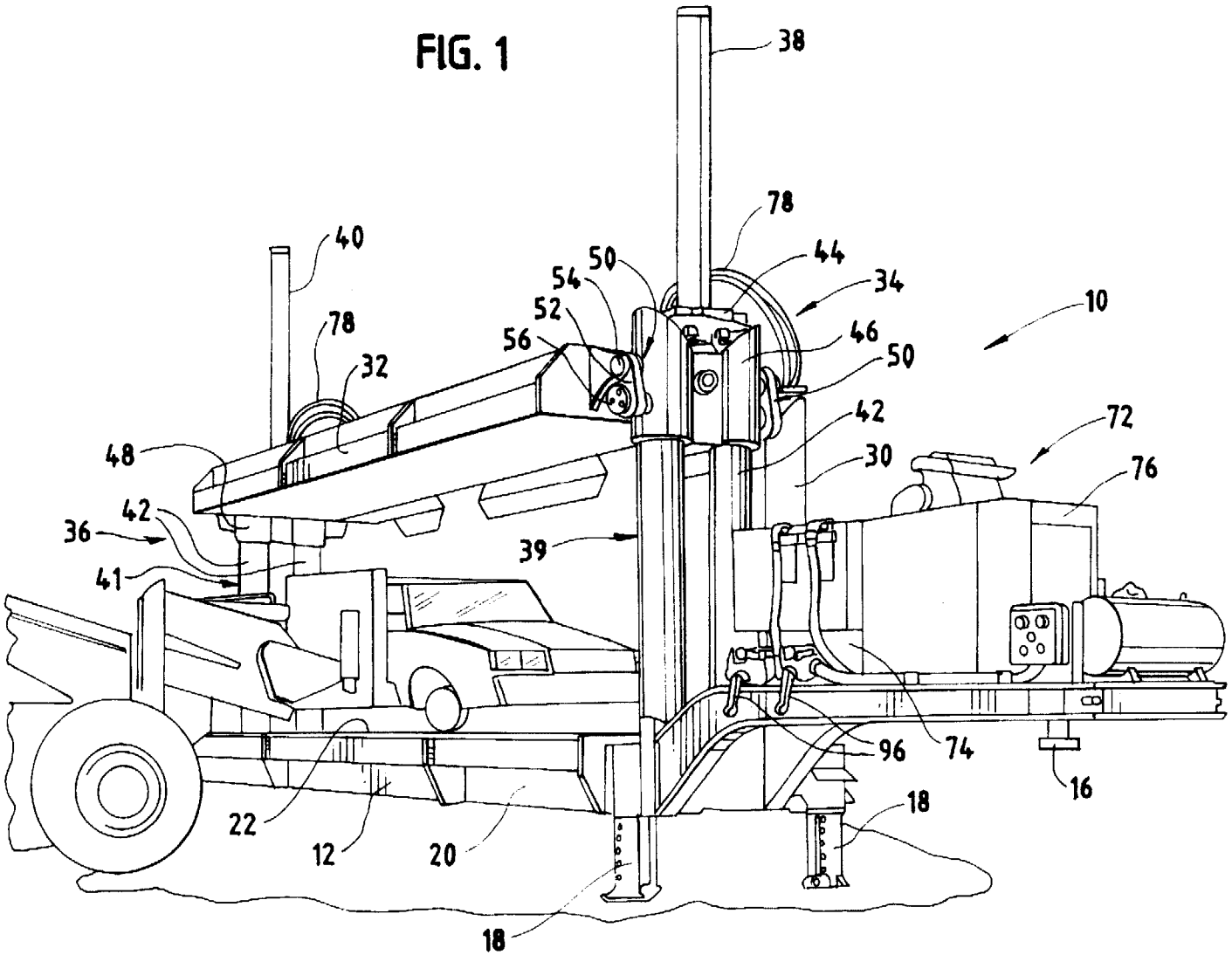
FIG. 1 is a perspective view of a mobile material press constructed in accordance with the present invention.

Referring now to FIGS. 1–10, a first embodiment of the present invention takes the form of a mobile material press 10 constructed as a semi-trailer 12. The rear end of the trailer is supported by a conventional dual tandem axle assembly 14 and the front end of the trailer includes a conventional fifth wheel coupler 16 which is connectable to a semi-tractor (not shown) for moving the trailer between job locations. The trailer also includes conventional landing gear 18 (sometimes referred to as dollies) for supporting the front of the trailer when the tractor is disconnected from the trailer.

The trailer 12 includes a base portion 20 defining a generally horizontal bed 22 upon which a vehicle (or other material) to be crushed may be placed. The bed 22 has first and second opposing ends 24, 26, a front edge 28, and a vertically extending back wall 30 which provides a solid backboard for positioning material during loading and unloading. (See FIG. 7). Material placed on the bed is crushed by a lid 32 which is slidably movable relative to the bed 22 along a pair of vertical guide mechanisms 34, 36 by a pair of hydraulic cylinders 38, 40.

The first and second guide mechanisms 34, 36 are disposed at the first and second ends 24, 26 of the bed, respectively. Each guide mechanism 34, 36 includes a respective pair 39, 41 of cylindrical guide posts 42 which extend upwardly from the bed 22 of the press 10. (See FIG. 6). The guide posts 42 in a given pair 39, 41 are spaced equidistance on opposite sides of the centerline 43 of the bed 22. (See FIG. 7). The lower ends of the guide posts 42 are rigidly secured to the base of the press 10, e.g. by welding or other suitable means, and the upper ends of the guide posts 42 in a given pair are rigidly secured to each other by a respective connecting linkage 44.

The guide mechanisms include guide sleeves 46, 48 which are slidably mounted on the first and second pairs 39, 41 of guide posts, respectively. Each guide sleeve 46, 48 is in turn pivotally connected to two corners of the lid 32 by a pair of pivot linkages 50. The pivot linkages 50 each comprise a rigid link member 52 and a pair of heavy duty pivot pins 54, 56. One of the pins 54 is pivotally connected to the lid 32 and the other pin 56 is pivotally connected to the guide sleeve 46, 48. The pivot linkages 50 permit pivotal movement of the lid 32 relative to the guide sleeve 46, 48 about two axes 58, 60. Each axis is generally parallel to the bed 22 and generally perpendicular to the vertical axis of the guide posts 42.

Figure 3:
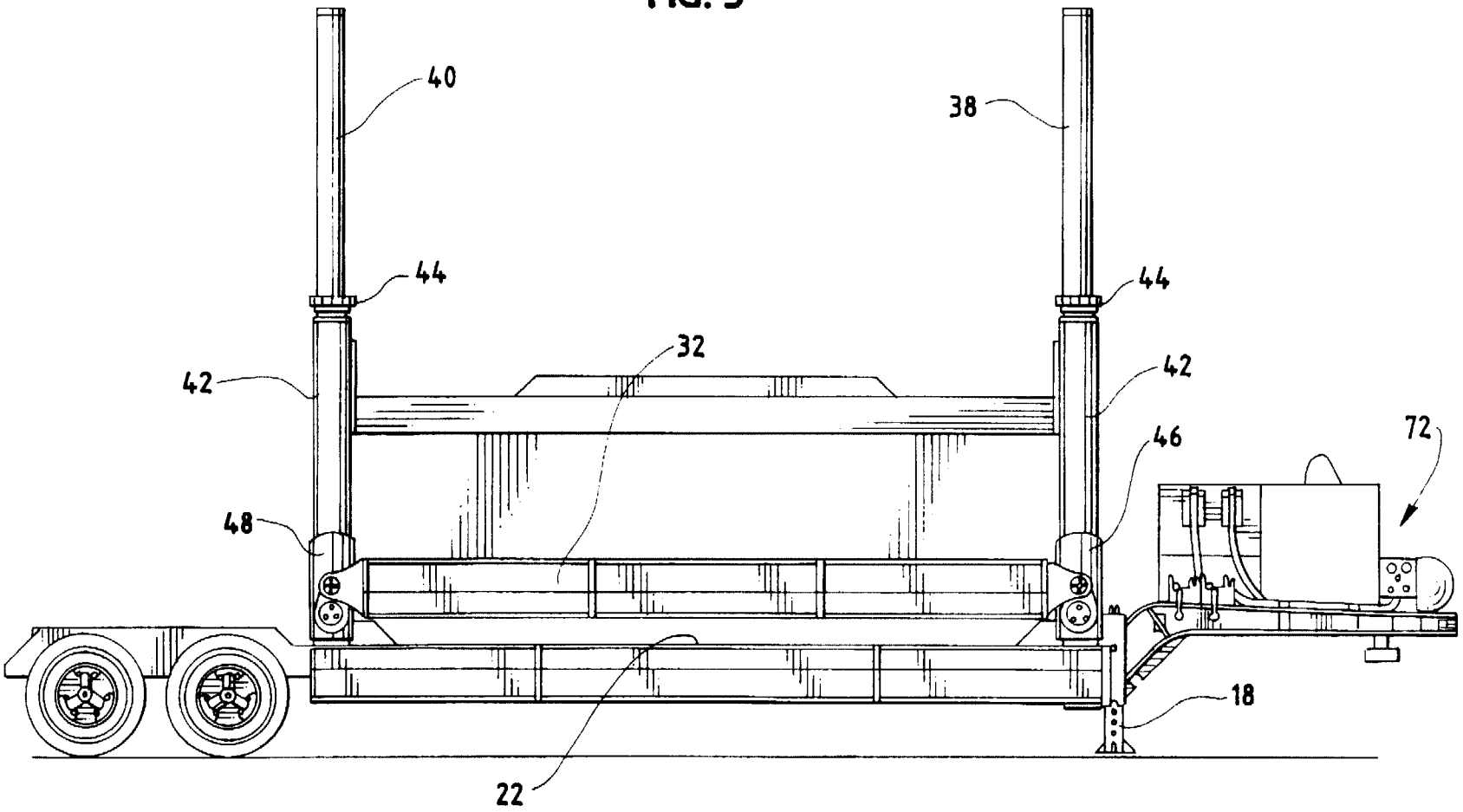
FIG. 3 is a side view of the mobile material press of FIG. 1, with the hydraulic cylinders casings moved to their raised position.
Figure 4:
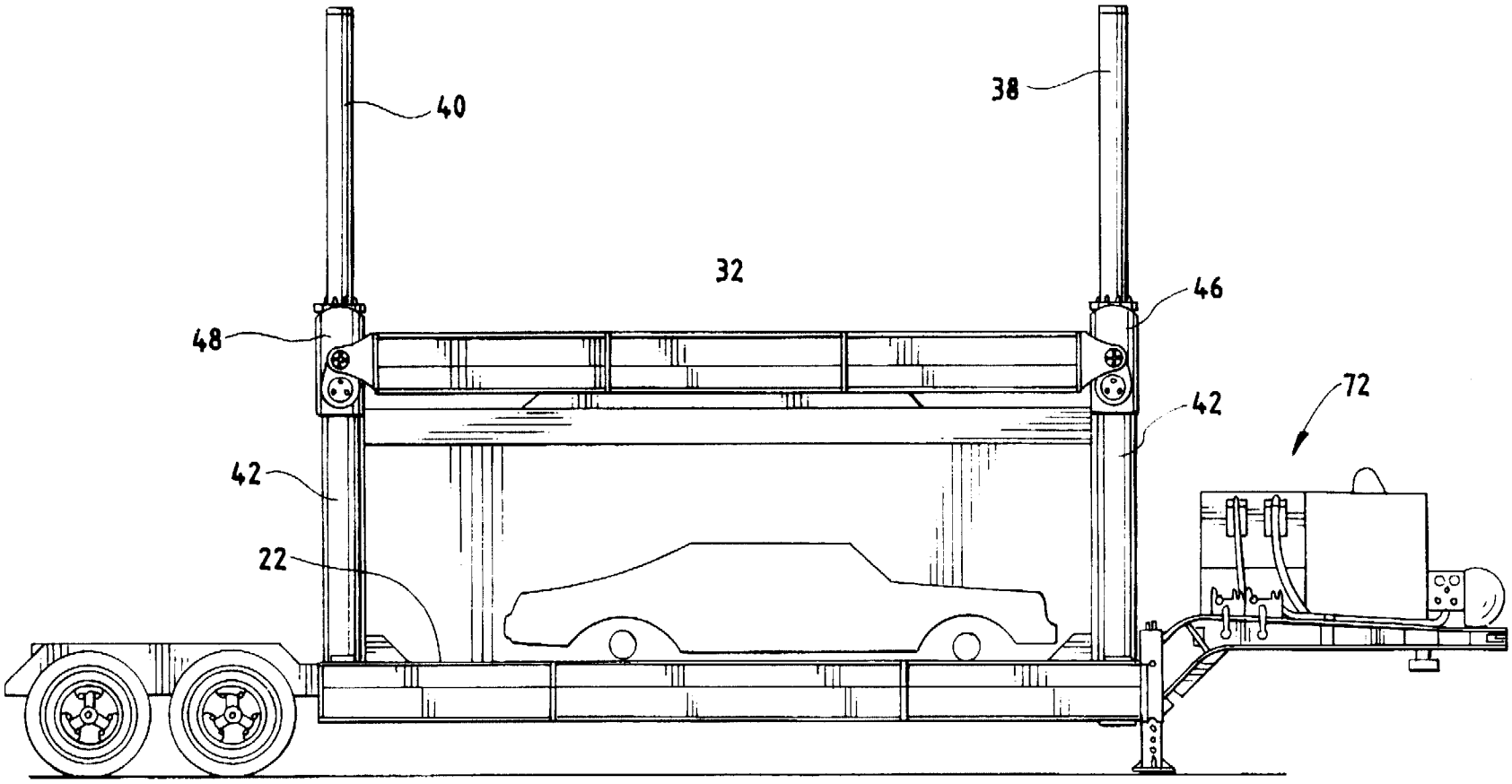
FIG. 4 is a side view of the mobile material press of FIG. 1, with the lid moved to its raised position in preparation for crushing a vehicle placed on the bed of the crusher.
Figure 5:
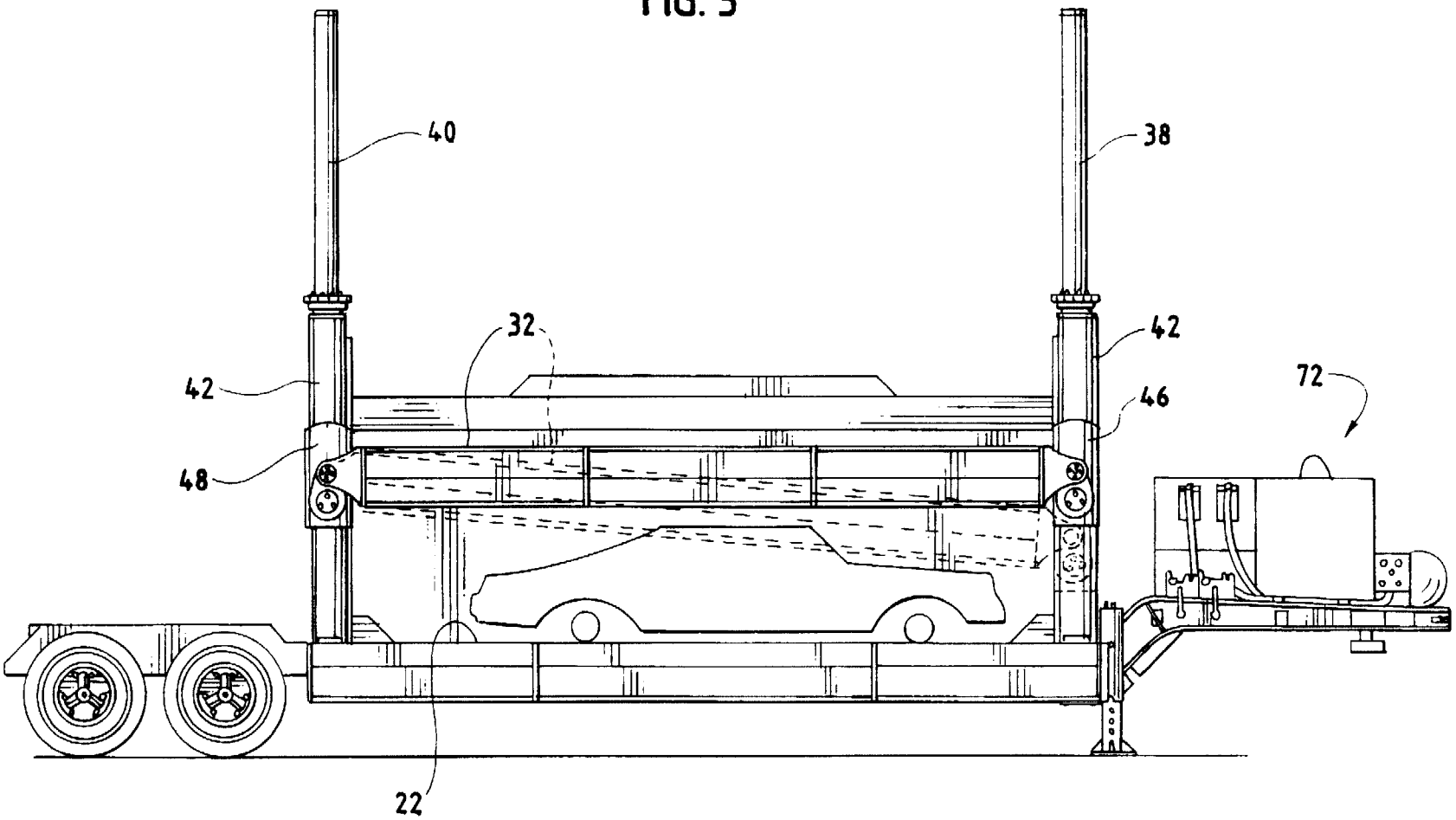
FIG. 5 is a side view of the mobile material press of FIG. 1, illustrating the lid at intermediate positions during a crushing operation.

The guide mechanisms 34, 36 permit the lid 32 to slidably move relative to the bed 22 between a lowered position at which the lid is juxtaposed next to the bed (see FIG. 3) and a raised position at which the lid is vertically displaced from the bed (see FIG. 4). The lid 32 is moved between its upper and lower positions by a pair of conventional hydraulic cylinders 38, 40 which are positioned at opposite ends of the lid. Specifically, the first hydraulic cylinder 38 is juxtaposed between the guide posts 42 in the first pair 39 and the second hydraulic cylinder 40 is juxtaposed between the guide posts 42 in the second pair 41.

Figure 6:
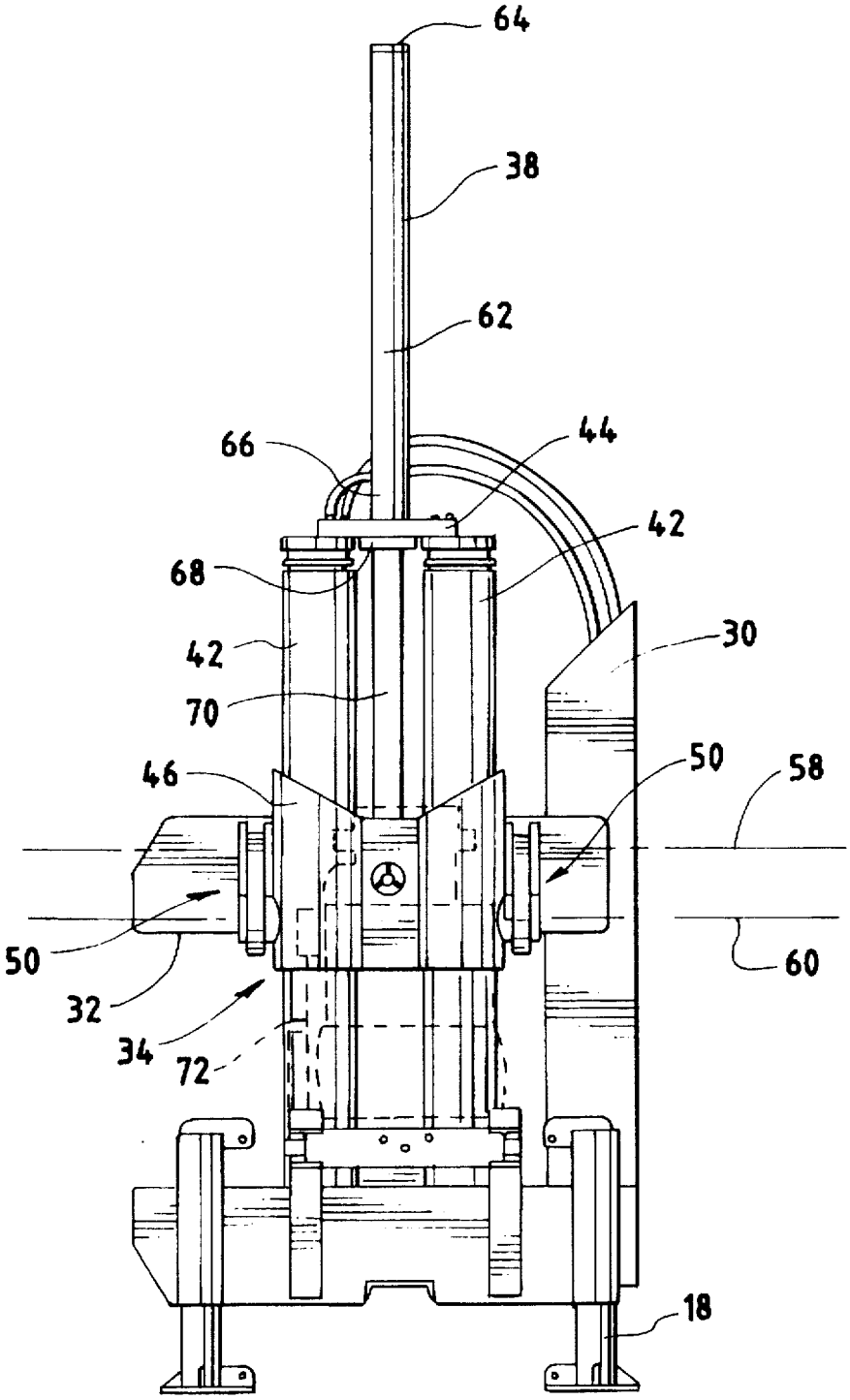
FIG. 6 is a front end view of the mobile material press of FIG. 1, with the hydraulic fluid supply system components shown in broken line.
Figure 7:
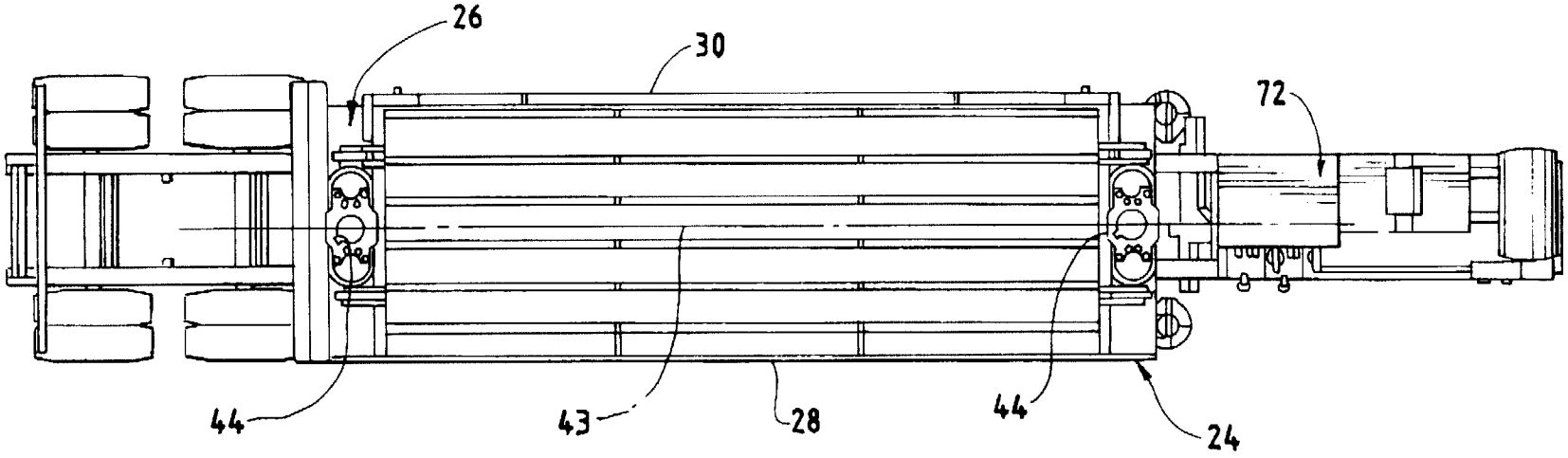
FIG. 7 is a top view of the mobile material press of FIG. 1.
Figure 8:
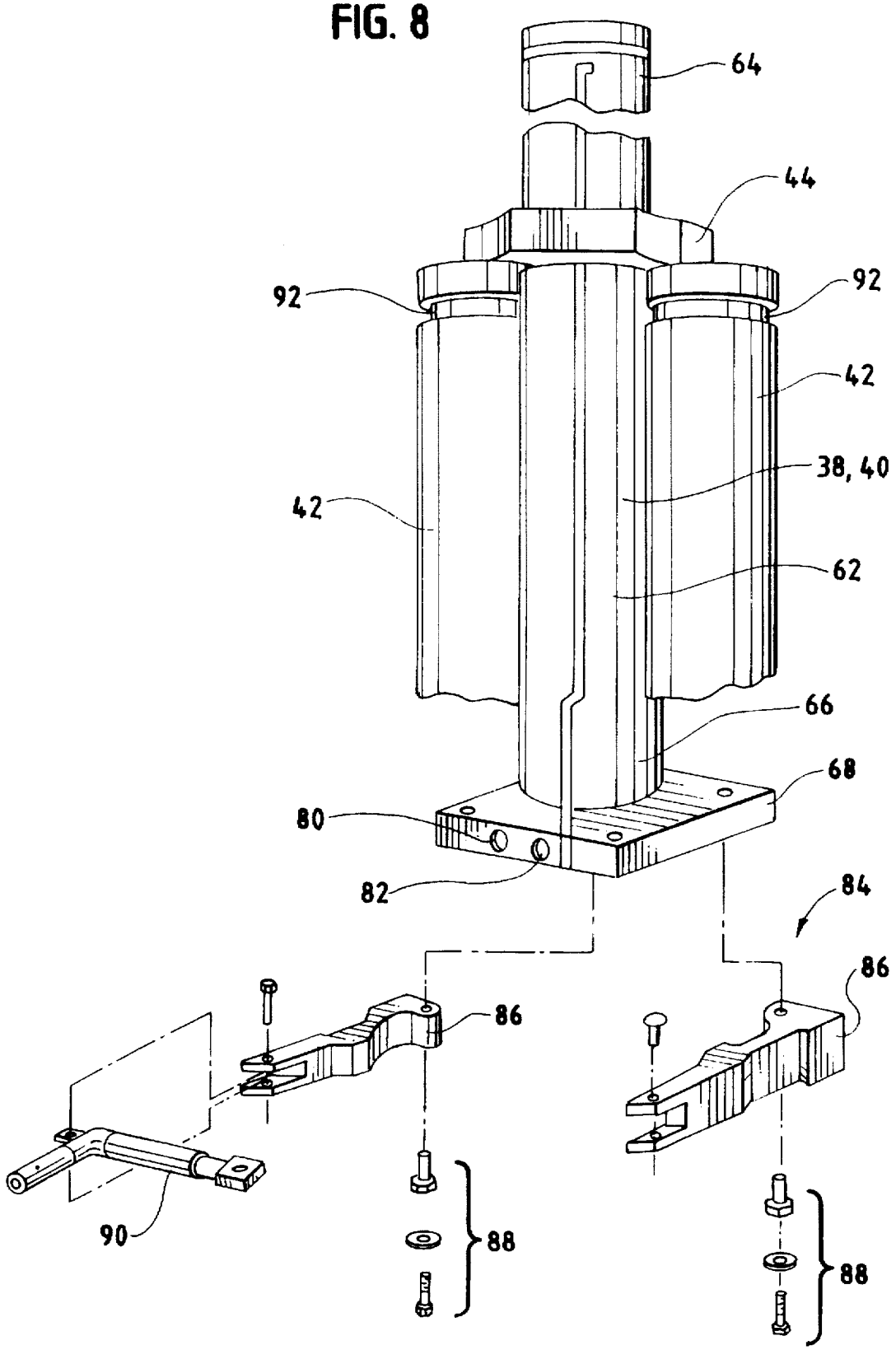
FIG. 8 is an exploded perspective view of one of the hydraulic cylinders and a respective locking mechanism which are employed in the mobile material press of FIG. 1.
Figure 9:
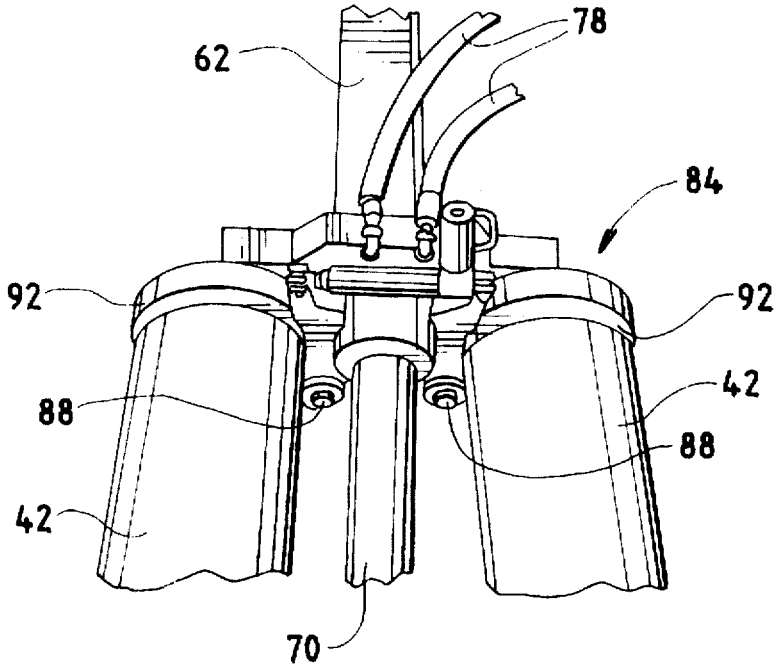
FIG. 9 is a perspective view of showing the cylinder locking mechanism at its unlocked position.
Figure 10:
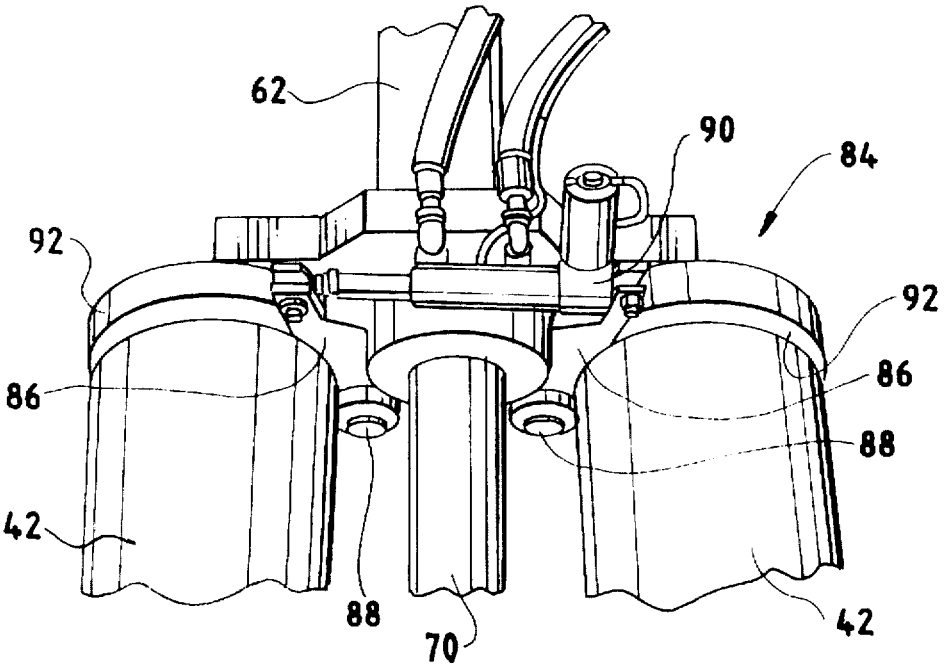
FIG. 10 is a perspective view of showing the cylinder locking mechanism at its locked position.

As can best be seen in FIGS. 6 and 8, each hydraulic cylinder 38, 40 includes an outer casing 62 having an upper end 64, a lower end 66, and a generally rectangular flange 68 (plate) secured to the lower end 62. Each cylinder 38, 40 further includes a cylinder rod 70 (see FIG. 6) which extends from the lower end 66 of the casing 62 and which has its outer (protruding) end fixedly secured to the top of the lid 32. Hydraulic fluid is controllably supplied to the hydraulic cylinder from an external source to move the cylinder rod 70 between a retracted position at which the outer end of the rod is proximal to the cylinder casing lower end and an extended position at which the outer end of the rod extends distally from the cylinder casing lower end. Specifically, each of the cylinders 38, 40 has a pair of fluid ports 80, 82, (see e.g. FIG. 8), and hydraulic fluid is supplied to one of the ports 80 to extend the cylinder rod 70 and the other port 82 to retract the cylinder rod.

For this purpose, the mobile press includes a hydraulic system (shown generally as element 72) adapted to deliver hydraulic fluid to the ports 80, 82 of the cylinders 38, 40 via fluid lines 78. The hydraulic system 72 includes a hydraulic pump assembly 74 which is powered by an engine 76 in a conventional manner for supplying hydraulic fluid to the hydraulic cylinders via the fluid lines 78.

The outer casings 62 of the hydraulic cylinders 38, 40 are slidably mounted within apertures formed in the connecting linkage 44 of a respective pair of guide posts. With the lid at its lowered position, the casings 62 may be raised by extending the cylinder rods 70 and lowered by retracting the cylinder rods. At the lowered position the casing lower ends 66 is proximal to the bed 22, and at the raised position the casing lower end 66 is displaced from the bed by a distance which exceeds the stroke length of the hydraulic cylinder (by a distance equal to the offset of the casing end from the bed when the cylinder's at its lowered position). When the cylinder is at its raised position, the flange abuts the lower face of a respective cross linkage 44 (see FIGS. 3, 9 and 10) to provide a bearing surface during the cylinder's extension stroke.

Locking mechanisms 84 are provided for automatically locking the cylinder casings 62 at their raised positions. Hence, the hydraulic cylinders can be raised above the bed to perform the crushing operation during their extension stroke and can be lowered to reduce the overall height of the press when it is necessary to move the press to a different location. As can best be seen in FIGS. 8–10, each locking mechanism 84 comprises a pair of locking arms 86 which are pivotally connected to the lower flange 68 of a respective cylinder casing by pivot pins. The locking arms 86 are movable between a retracted position (see FIG. 9) and an extended position (see FIG. 10) by an actuator 90 which is positioned between the free ends of the locking arms 86. A suitable actuator is an electro-mechanical actuator such as is commercially available for Duff-Norton of Charlotte, N.C. As will be appreciated, the actuator could assume other forms, such as a hydraulic actuator, pneumatic actuator, a servo motor, etc.

When the cylinder casing 62 is moved its raised position, the locking arms 86 align with reciprocal keyways 92 or grooves formed in the upper periphery of the guide posts. The actuator 90 is then actuated to extend the locking arms 86 outwardly and into the reciprocal keyways 92, thereby locking the cylinder casing in its raised position. Once the casings 62 are locked in their raised position by the locking mechanisms 84, the cylinder rods 70 may be retracted to move the lid 32 to its raised position and extended to move the lid 32 to its lowered position to crush materials placed on the bed 22 of the press. It should be noted that the linkage arms only serve to keep the casings 62 from falling when the cylinder rods 70 are retracted; they do not counteract the force created when the lid crushes materials. Rather, this force is transferred through the interface between the lower flanges 68 of the cylinders 38, 40 and the connecting linkages 44. As will be apparent, the locking mechanisms 84 can readily take numerous other forms. For example, the locking arms could be carried by the guide posts and positioned to lock into a groove formed in the cylinder casing. Finally, the locking arms could also slide, as opposed to pivoting.

Figure 2:
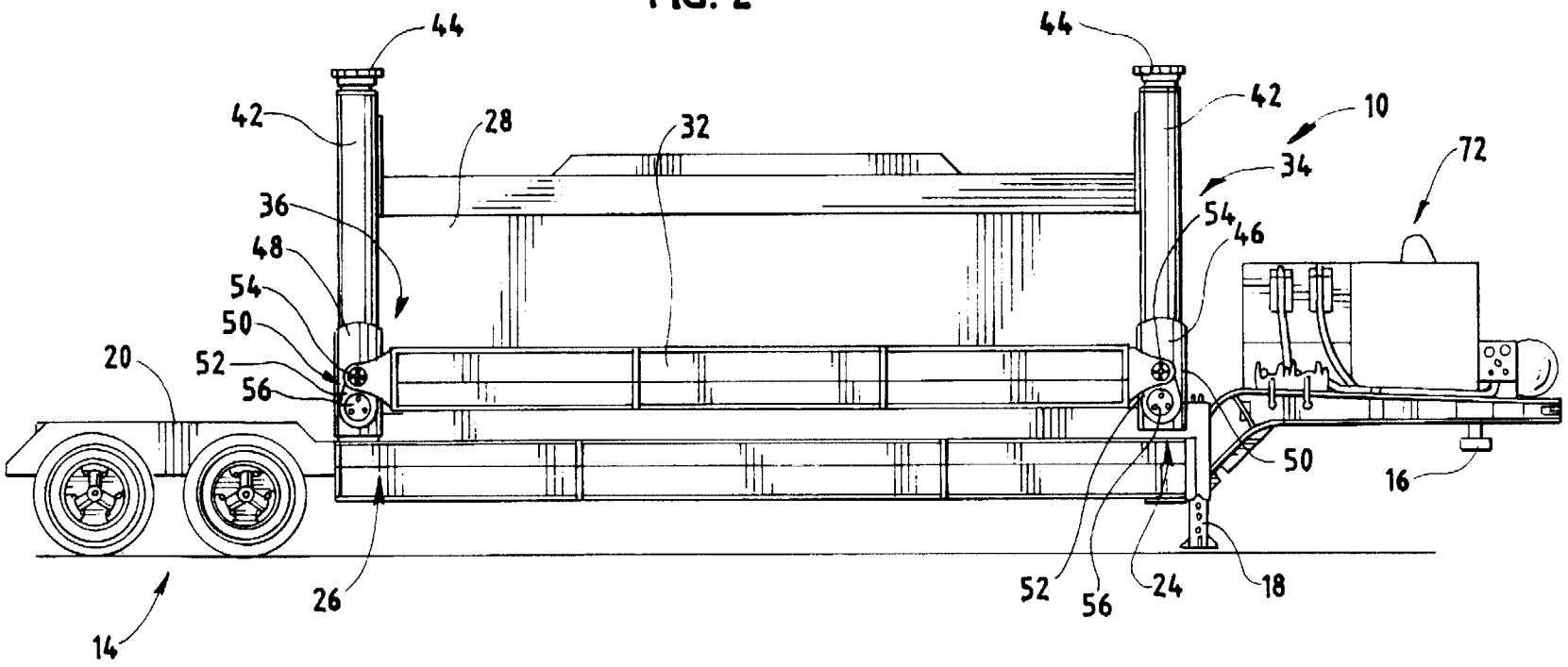
FIG. 2 is a side view of the mobile material press of FIG. 1, with the hydraulic cylinder casings moved to their lowered position.

Operation of the mobile press 10 will now be explained by way of example. Initially, the mobile press 10 is transported to a new job site with the lid 32 and cylinder casings 62 in their lowered position as shown in FIG. 2. When the press 10 arrives at the job site, it is appropriately positioned and the landing gear 18 are lowered to support the front end of the trailer 12. The semi-tractor (not shown) may be left in place under the trailer, or it may be uncoupled from the fifth wheel coupler and moved in which case the front end of the trailer is supported by the landing gear 18.

Once the trailer is appropriately positioned at the job site, the press 10 is readied for operation by extending the hydraulic cylinders 38, 40 to drive the cylinder casings 62 to their raised position (See FIG. 3). When the cylinder casings 62 reach their raised position, the locking actuators 90 are energized to drive the locking arms 88 into the keyways 92, thereby locking the casings in their raised position (See FIGS. 9 and 10). In order to simplify the overall system, the locking actuators 90 are preferably actuated by a manual switch. However, the press 10 could also incorporate a means for automatically activating the locking actuators 90 in response to the cylinder casings 62 being moved to their raised position. For example, proximity sensors (not shown) could be provided for sensing the position of the casings 62 and producing output signals in response to the casings reached their raised position. These output signals could be delivered to a control system (such as a microprocessor based controller or a hard-wired control system) which would in turn activate the locking actuators 90.

With the casings 62 locked in their raised position, the cylinder rods 70 are retracted to move the lid 32 to its raised position to ready the press for receiving a vehicle (or other material to be crushed) (See FIG. 4). The material to be crushed is then placed on the bed 22 of the press 10, e.g. by a forklift, (see, e.g. FIG. 1).

Once the material is placed on the bed, the lid 32 is driven downwardly (by extending the cylinder rods 70) to crush the material on the bed. Because the cylinders crush the material during their extension stroke, the press 12 makes efficient use of the available power. Preferably the mobile press 10 includes a controller (not shown), such as a hydraulic controller or a microprocessor based controller, for automatically cycling the lid 32 through a predetermined crushing cycle, as is well known in the art. The press 10 also includes control levers 96 which may be used to manually control the operation of the hydraulic cylinders (both during the crushing operations and to raise and lower the cylinder casings). During the crushing cycle, the hydraulic cylinders 38, 40 are controllably actuated by the controller in accordance with a predetermined sequence. As part of this operation, the cylinders 38, 40 are alternatively actuated to cause the lid 32 to rock up and down, as is shown in broken lines in FIG. 5.

When it is necessary to move the press 10 to a new location, the cylinder rods 70 are extended to move the lid 32 to its lowered position. The actuators 90 are then de-energized, to retract the locking arms 68 from the keyways and release the cylinder casings 62 from their raised, locked position. The cylinder rods 70 are then retracted to lower the cylinder casings 62.

The cylinders 38, 40 crush the material by pushing down onto the load instead of pulling down (as is typical in prior systems. Crushing during the pushing (or extension) mode also eliminates the need for cylinder eyes (which can break off and be damage during operation) to connect the cylinder rods 70 to the lid 32.

Figure 11:
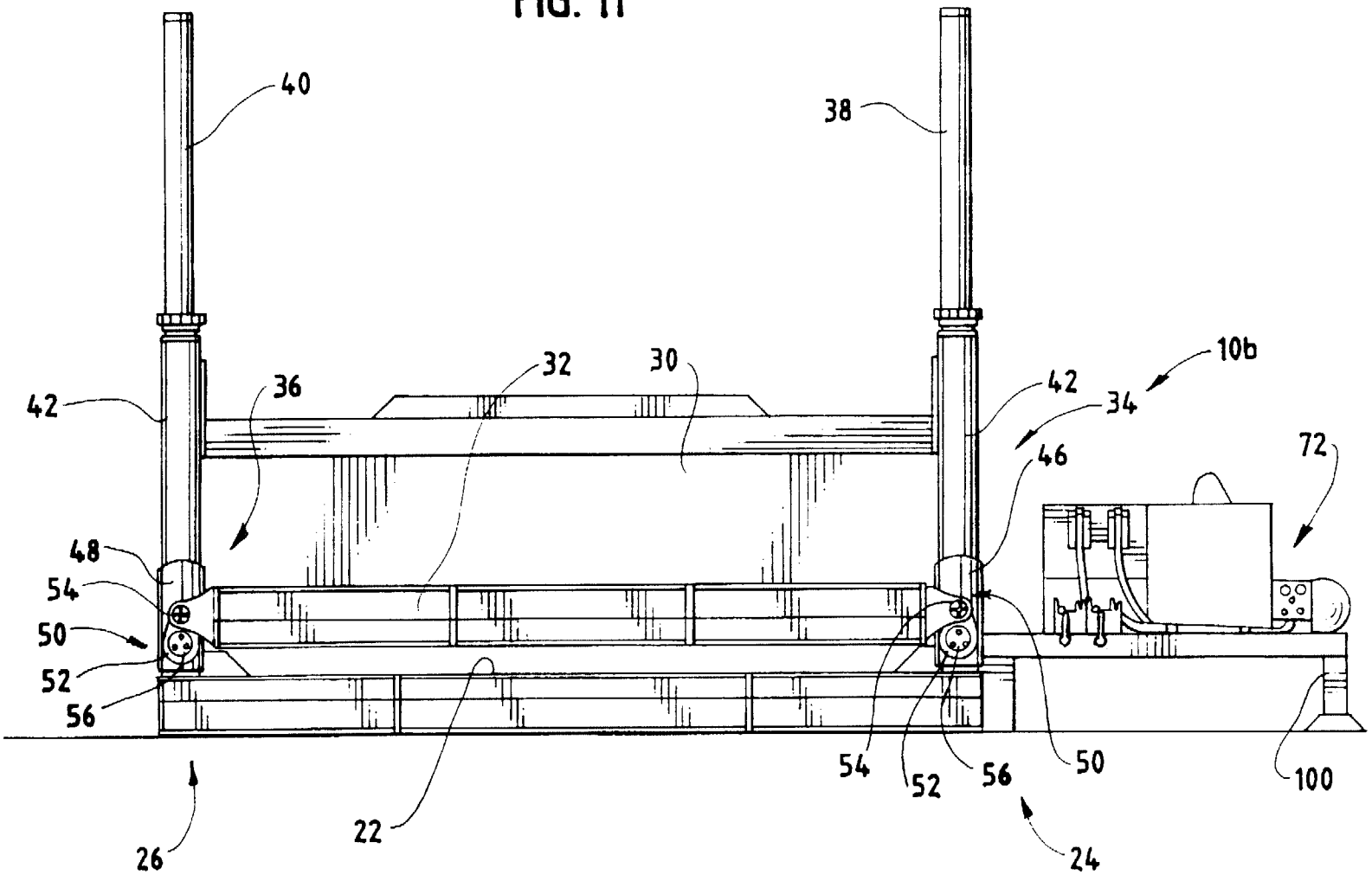
FIG. 11 is a front elevation view of a stationary material press constructed in accordance with certain aspects of the present invention.
Figure 12:
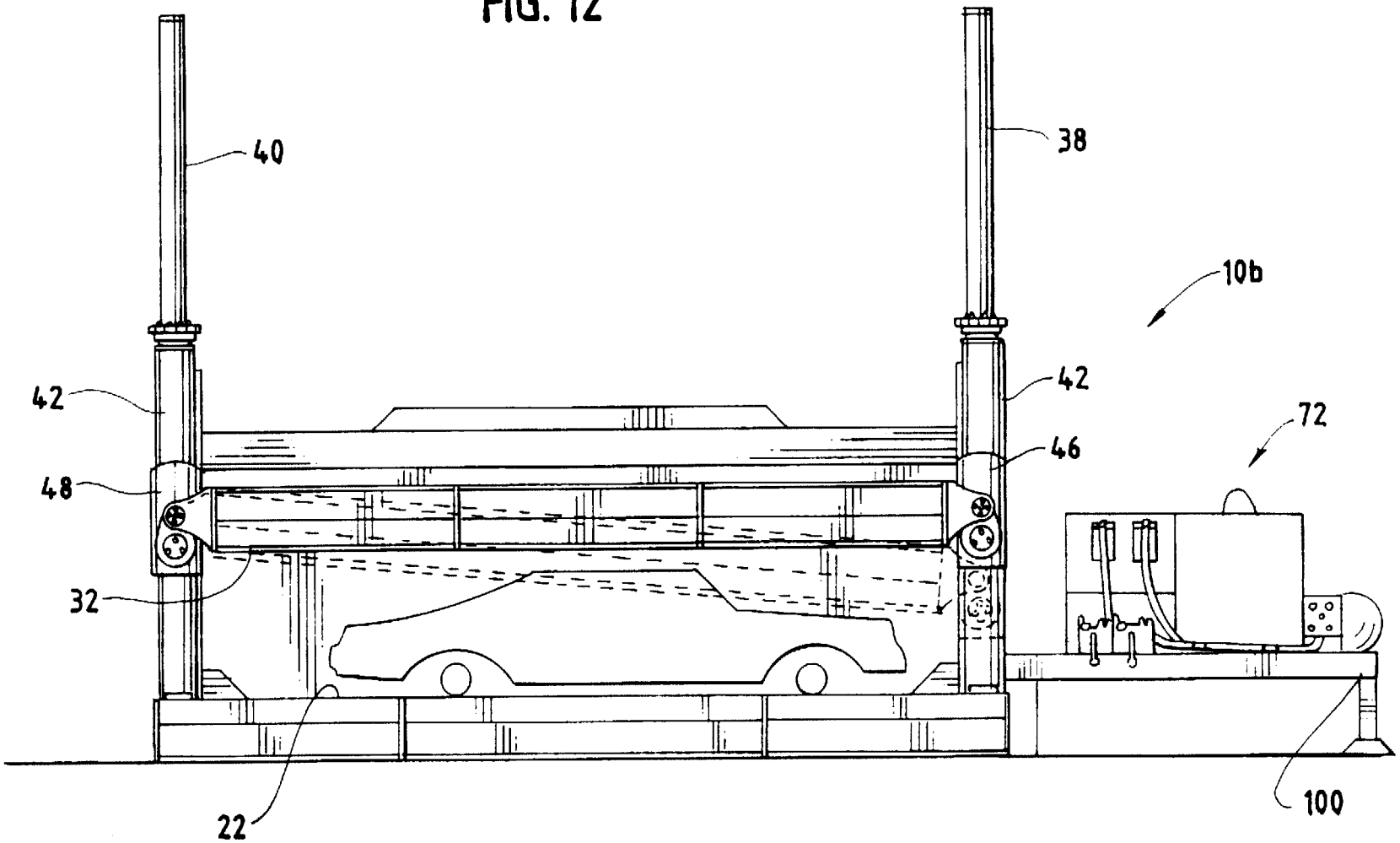
FIG. 12 is a front elevation view of a stationary material press of FIG. 11, illustrating the lid at intermediate positions during a crushing operation.

Referring now to FIGS. 11 and 12, a stationary material press **10*b* is described. The stationary press 10*b* of FIGS. 11 and 12 uses most of the same components as the mobile press illustrated in FIGS. 1 through 10. Hence, the same element numbers have been used to identify like components. The primary difference is that the base 20 of the stationary press 10 is fixed, as opposed to being in the form of a semi-trailer. Hence, the stationary press does not have the fifth wheel coupler nor tandem axle of the first embodiment. The stationary press 10*b* may also includes a stand 100 for supporting the hydraulic system 72 above the ground. Additionally, in order to reduce cost it may be desirable to eliminate the locking mechanism 84 in the stationary press 10*b*. In such instances, the cylinder casings 62 may be locked in their raised position by mechanical fastening devices, e.g. by using threaded fasteners to secure the casing flanges 68 to the cross-linkages 44. As will be appreciated, it is not necessary to provide keyways 92 in the guide posts 42** if mechanical fastening devices are used instead of the locking mechanisms.

The material press 10 described herein has significant advantages over know lid-type presses. First, in the context of mobile presses, the locking mechanisms 84 of the present mobile material press greatly reduces the set-up and take down time in comparison to prior mobile presses. Second, the guide mechanisms 34, 36, which consists of the guide posts 42, the sliding guide sleeves 46, 48, and the pivot linkages 50, are designed to maximize crushing capability while minimizing the stress on the overall machine. Specifically, the guide mechanisms 34, 36 provide equal distribution of the crushing force to the four corners of the crushing lid 32, as opposed to the conventional approach of pulling or pushing on just two points. The pivotal connection between the four corners of the lid 32 and the guide sleeves 46, 48 insures that the force generated by the hydraulic cylinders during the crushing cycle is directed squarely onto the load. Finally, the load stress created during the crushing cycle is distributed equally across the components of the guide mechanisms 34, 36. This allows the pressure to be shared by these heavy-duty re-enforced areas of the machine which increases the strength and durability of the press 10. Moreover, because the pairs of posts are laterally constrained by the connection linkages and the sliding guides, the posts cannot spread apart while crushing uneven loads.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A material press, comprising:

a generally horizontal, elongated bed having first and second vertical guide mechanism extending from opposite ends of the bed;

a lid slidably connected to the guide mechanisms for vertically movement relative to the bed between an upper position at which the lid is vertically displaced from the bed and a lower position at which the lid is juxtaposed next to the bed;

a pair of hydraulic cylinders mounted for moving the lid between its upper and lower positions, each of the cylinders including an outer casing having an upper end, a lower end and a flange extending from the lower end, and a cylinder rod extending from the casing lower end and being movable between an extended position and a retracted position in response to hydraulic fluid supplied to the cylinder casing from an external source;

each of the cylinders having its casings slidably connected to one of the guide mechanisms and its rod fixedly connected to the lid, the cylinder casings being movable between a lowered position at which the lower end is proximal to the bed and a raised position at which the casing lower end is vertically displaced from the bed by a distance which exceeds the stroke length of the cylinder rod;

first and second locking mechanisms adapted for controllably locking the position of the first and second hydraulic cylinders casings, each locking mechanism comprising:

a locking member movable between a first position at which the hydraulic cylinder casing freely slides with respect to the guide mechanism and a second position which locks the position of the hydraulic cylinder casing relative to the respective guide mechanism; and means for controllably moving the locking member between its first and second positions; and wherein the cylinder casings may be moved to their lowered position to reduce the overall height of the vehicle crusher during movement between locations by disengaging the locking mechanism and retracting the cylinder rods, and wherein the casings may be raised to their upper position by moving the cylinder rods to their extended positions at which time the locking mechanism is activated to lock the casings in its raised position after which the lid may be raised by retracting the cylinder rods and lowered by extending the cylinder rods.

2. A material press as set forth in claim 1, wherein each guide mechanism comprises a pair of laterally spaced guide posts which extend vertically from the bed.

3. A material press as set forth in claim 2, wherein the guide posts in a given pair are spaced equidistance on opposite sides of the centerline of the bed.

4. A material press as set forth in claim 2, further comprising first and second guide sleeves slidably mounted on the first and second pairs of guide posts respectively, and wherein the lid is connected to the guide sleeves for sliding movement along the guide posts.

5. A material press as set forth in claim 4, wherein the lid is pivotally connected to the guide sleeves by a plurality of pivot linkages.

6. A material press as set forth in claim 4, wherein the guide sleeves restrict lateral displacement of the guide post relative to each other.

7. A material press as set forth in claim 2, further comprising linkage members rigidly connecting the upper ends of the guide posts in a given pair to restrict lateral displacement of the guide posts relative to each other.

8. A material press as set forth in claim 2, wherein each locking member comprises a pair of locking arms which are movably connected to the cylinder casing and which are positioned to align with reciprocal grooves formed in the guide posts when the cylinder casing is moved to its raised position; and wherein the means for moving the locking member comprises an actuator adapted to move the locking arms into and out of engagement with the guide post grooves to controllably lock the cylinder casing.

9. A material press as set forth in claim 8, wherein the actuator comprises an electromechanical actuator.

10. A material press as set forth in claim 8, wherein the locking arms are pivotally connected to said cylinder casing.

11. A material press as set forth in claim 1, wherein the bed is carried by a base in the form of a semi-trailer.

12. A material press, comprising:

a generally horizontal, elongated bed having first and second opposing ends;

first and second pairs of laterally spaced guide posts extending vertically from the first and second ends of the bed, respectively;

first and second guide sleeves slidably mounted on the first and second pairs of guide posts, respectively;

a lid pivotally connected to the guide sleeves by a plurality of pivot linkages which permit the lid to pivot relative to the guide sleeves about two axes, each axis being generally parallel to the bed and generally perpendicular to the vertical axis of the guide posts;

first and second hydraulic cylinders associated with the first and second pairs of guide posts, respectively, each cylinder having an external casing and a cylinder rod extending from the casing and being movable between an extended position and a retracted position in response to hydraulic fluid supplied to the cylinder casing from an external source, each of the cylinders having its casings connected to a respective one of the pairs of guide posts and its rod fixedly connected to the lid for moving the lid between an upper position at which the lid is vertically displaced from the bed and a lower position at which the lid is juxtaposed next to the bed.

13. A material press as set forth in claim 12, wherein the guide posts in a given pair are spaced equidistance on opposite sides of the centerline of the bed.

14. A material press as set forth in claim 12, wherein the guide sleeves restrict lateral displacement of the guide post relative to each other.

15. A material press as set forth in claim 12, further comprising linkage members rigidly connecting the upper ends of the guide posts in a given pair to restrict lateral displacement of the guide post relative to each other.

16. A material press as set forth in claim 12, wherein the lid is generally rectangular and wherein each corner of the lid is connected to one of the guide sleeves by one of the pivot linkages.

17. A material press as set forth in claim 12, wherein each of the cylinders has its casing slidably connected to one of the pairs of guide posts for movement between a lowered position at which the lower end of the cylinder casing is proximal to the bed and a raised position at which the lower end of the cylinder casing is vertically displaced from the bed by a distance which exceeds the stroke length of the cylinder rod; and wherein the press further comprises:

first and second locking mechanisms adapted for controllably locking the position of the first and second hydraulic cylinders casings, respectively, each locking mechanism comprising:

a locking member movable between a first position at which the hydraulic cylinder casing freely slides with respect to the guide posts and a second position which locks the position of the hydraulic cylinder casing relative to the guide posts; and means for controllably moving the locking member between its first and second positions.

18. A material press as set forth in claim 17, wherein each locking member comprises a pair of locking arms which are movably connected to the cylinder casing and which are positioned to align with reciprocal grooves formed in the guide posts when the cylinder casing is moved to its raised position; and wherein the means for moving the locking member comprises an actuator adapted to move the locking arms into and out of engagement with the guide post grooves to controllably lock the cylinder casing.

19. A material press as set forth in claim 18, wherein the actuator comprises an electromechanical actuator.

20. A material press as set forth in claim 12, wherein the bed is carried by a base in the form of a semi-trailer.

* * * * *